US006258235B1

(12) United States Patent
Houziel et al.

(10) Patent No.: US 6,258,235 B1
(45) Date of Patent: Jul. 10, 2001

(54) PROCESS AND INSTALLATION FOR COATING A SURFACE BY ELECTROPHORESIS

(75) Inventors: Jacques Houziel, Creil; Philippe Delobel, Brenouille, both of (FR)

(73) Assignee: Sollac, Puteaux (FR)

( * ) Notice: Subject to any disclaimer, the term of this patent is extended or adjusted under 35 U.S.C. 154(b) by 0 days.

(21) Appl. No.: 09/325,353

(22) Filed: Jun. 4, 1999

(30) Foreign Application Priority Data

Jun. 4, 1998 (FR) ..... 98 06969

(51) Int. Cl.[7] ..... C25D 13/00
(52) U.S. Cl. ..... 204/472; 204/471
(58) Field of Search ..... 204/471, 472

(56) References Cited

PUBLICATIONS

Patent Abstracts of Japan, vol. 013, No. 336, (C–623), Uul. 27, 1989 & JP 01 111899 A (Mitsubishi Motors Corp); Apr. 28, 1989.

Patent Abstracts of Japan, vol. 097, No. 007, Jul. 31, 1997 & JP 09 087893 A (Nippon Paint Co Ltd), Mar. 31, 1997.

Patent Abstracts of Japan, vol. 097, No. 012, Dec. 25, 1997 & JP 09 217199 A (Olympus Optical Co Ltd), Aug. 9, 1997.

*Primary Examiner*—Kathryn Gorgos
*Assistant Examiner*—Christopher M. Keehan
(74) *Attorney, Agent, or Firm*—Oblon, Spivak, McClelland, Maier & Neustadt, P.C.

(57) ABSTRACT

An electrophoretic coating process of the surface of a sample in a bath, and a coating system, in which, during the flow of an electrophoretic current, one subjects the bath or the sample to vibrational movements so as to produce vaporous cavitations in the vicinity of the surface of the sample. The vibrations may be applied only in an initial phase of the beginning of current flow and/or only in a second phase at the end of current flow. In the system, the vibrations are generated using vibrational generators positioned in only at least one of the beginning and end positions of the container holding the bath.

28 Claims, 3 Drawing Sheets

PROCESS AND INSTALLATION FOR COATING A SURFACE BY ELECTROPHORESIS

BACKGROUND OF THE INVENTION

1. Field of the Invention

The present invention relates to a process and installation for coating by electrophoresis the surface of a substrate immersed in an electrophoretic bath, and more particularly to an process and installation for coating where the bath in the vicinity of the surface is subjected to vibrational movements, particularly at sound or ultrasound frequencies.

2. Discussion of the Background

Painting by means of electrophoresis is mainly used for parts of an automobile body. The electrophoretic bath is generally comprised of an aqueous solution of a film-forming polymer material; polyepoxide type resins are widely used. An electrophoretic electric current is used to take the particles of the emulsion toward the part to be painted where they will comprise the paint layer; the electrical resistance between the part to be painted and the counter electrode increases with the thickness of the deposit.

Surface defects may be generated during this process. The surface defects of the paint layer have the form of craters which, on sheets of steel, are sites where corrosion tends to begin; in addition, in spite of the three additional layers of paint (respectively called "sealer," "base" and "varnish") which one subjects the visible parts of the vehicle body to above the cataphoresis layer, the craters remain visible and greatly degrade the appearance of these parts. These craters are present in the form of small cone-shaped holes which open onto the surface of the cataphoretic layer; they have a diameter generally between 100 and 500 micrometers at the base, between 5 and 20 micrometers at the top. These so-called "craterization" defects result from the formation of a gas, particularly hydrogen, in the vicinity of the surface area of the part during coating.

An automobile body painting unit in the traditional manner includes a container of paint and a conveyor unit for immersing the part in the bath, moving it along the bath and extracting it from the bath, as described in JP 87-268321 A, for example. The length of the container and the movement speed of the part in the container are adjusted to the thickness of the paint layer to be deposited, depending upon the paint depositing rate. The rate of depositing is proportional to the electric field in the vicinity of the part to be painted; that is, the potential difference applied between the electrode and the back electrode; with constant polarization, this speed decreases as a function of the time until it is nearly canceled when the thickness of the deposited paint layer offers a considerable electrical resistance to passage of the electrophoretic current. The part extracted from the bath is dried in order to ensure baking of the coating; for polyepoxide-type resins, the drying process lasts about 20 minutes at approximately 180° C.

As described in JP 87-268321A, when one applies a paint coating in this manner onto sheets of steel coated with zinc or a zinc alloy, especially sheets of alloy galvanized steel, one will observe surface defects ("pinhole gases") on the layer of paint, which result from the formation of gas bubbles on the surface to be painted during electrical deposition. In order to prevent the formation of these defects, JP 87-268321A proposes that one can subject the electrophoretic bath to vibrational movements at ultrasound frequencies during the passage of the electrophoretic current.

In order to produce vibrations in the bath, one immerses ultrasound-emitting generators in the bath along the movement path of the part, on either side of the part; these ultrasound emitters are distributed on either side of the movement path along two longitudinal walls of the paint container (reference numeral 7 in FIGS. 1 and 2 of JP 87-268329A) and are connected to an adjustable power supply device. This ultrasound electrodeposition process is expensive because it requires the installation of many emitters along the movement path of the parts.

SUMMARY OF THE INVENTION

An object of the invention is to provide a process and system for coating a surface by electrophoresis which are more economical.

Another object of the invention is to provide a process and system for coating by electrophoresis a surface with no or fewer resulting defects.

A further object of the invention is to provide a process and system for coating a surface where deposition rates may be improved.

These and other objects are achieved by a coating process by electrophoresis of a surface of a substrate immersed in an electrophoresis bath, comprising steps of applying an electrical current to the surface, during applying the current, subjecting one of the bath and the sample to vibrational movements to generate vaporous cavitations in a vicinity of the surface, and applying the vibrational movements for a period substantially less than a time period over which the current is applied. Generating the vibrational movements may be performed only during at least one of an initial phase at a beginning of application of the current and a second phase at an end of application of the current. The initial phase may begin approximately at the onset of the application of the current and ends before a time corresponding to half of a duration of application of the current, and the second phase may begin after this time and ends approximately at an end of the application of the current.

The end of the initial phase may occur approximately at a moment corresponding to an inflection point of a characteristic, as a function of time, of electrical resistance measured between the surface area and a counter-electrode under the same conditions of the coating but in the absence of the the vibrational movements.

The vibrational movements may be generated in the initial phase for no more than one fourth of a duration of the application of the current. The vibrational movements may be generated only in the initial phase, or only in the second phase.

During the initial phase, a current may be applied to produce a polarization voltage greater than a crater forming voltage of the surface. The current may be applied such that a duration of a rise of the polarization voltage rise up to a predetermined value greater than the crater forming voltage is less than 1 second.

The process may also include steps of determining an inflection point in a characteristic of electrical resistance between the surface and a counter electrode as a function of time determined in absence of the vibrational movements, and stopping the generation of the vibrational movements at a time approximately corresponding to the inflection point.

The vibrational movements may be generated in the bath using one of sound and ultrasound waves, or they may be generated by vibrating the substrate at one of sound and ultrasound frequencies. The vibrational movements may be generated only in the vicinity of predetermined zones of the surface area.

The process and system may be applied to coating a substrate made of alloy galvanized steel.

The process may include steps of immersing the substrate in the bath, conveying the substrate through the bath, and extracting the substrate from the bath. In this case the vibrational movements may be generated only during at least one of an initial phase including the immersing step at a beginning of application of the current and a second phase including the extracting step at an end of application of the current or generated in the initial phase for no more than one fourth of a duration of the immersing, conveying and extracting steps. The vibrational movements may be generated only in the initial phase or second phase, or only in the vicinity of predetermined zones of surface during the second phase. The end of the initial phase may occur approximately at a moment corresponding to an inflection point of a characteristic, as a function of time, of electrical resistance measured between the surface area and a counter-electrode under the same conditions but in the absence of the the vibrational movements.

The process according to the invention may also comprise immersing a surface in an electrophoresis bath, extracting the surface from the bath, and applying vibrational movements to one of the surface and the bath to generate vaporous cavitations in the vicinity of the surface at only at least one of an immersion point and an extraction point. The vibrational movements may be applied only the immersion point or only at the extraction point, or only to predetermined portions of the surface. A current maybe applied to the surface using a counter-electrode and applying the vibrational movements may be performed during application of the current up to approximately a moment corresponding to an inflection point of a characteristic, as a function of time, of electrical resistance measured between surface and a counter-electrode in the absence of the vibrational movements.

These and other objects may be achieved by a system for coating of a surface of a part by electrophoresis comprising a container holding an electrophoresis bath and a vibrational generator to apply vibrational movements to the bath to generate vaporous cavitations in the vicinity of the surface disposed at only at least one of an immersion point and an extraction point in the container for the part. The system may include a device to immerse the surface area in the bath, to remove the surface area from the bath, and to convey the part from the immersion point to the extraction point. The system may also include a counter electrode for applying an electrical current to surface, where the vibrational generator applies the vibrational movements during application of the current.

The vibrational generator may be disposed to generate the vibrational movements only in an immersion zone ending at approximately at a location in the container corresponding to an inflection point of the curve R(t) of evolution, as a function of time, of electrical resistance measured between the surface and the counter-electrode in the absence of the vibrational movements. It may also be positioned to generate the vibrational movements substantially only in an immersion zone in a direction of movement having a length no more than one fourth of a length of the container. The vibrational generator may be one of a sound generator and an ultrasound generator.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The present application claims priority from French Patent Application 98 06 969, the disclosure of which is herein incorporated by reference.

Figure 1:
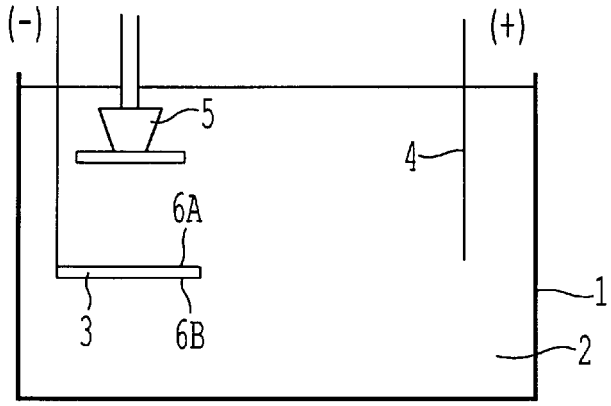
FIG. 1 is a schematic representation of a paint unit used for the examples described below.

Referring to the drawings, and in particular to FIG. 1, an embodiment of the system according to the invention will be described. A container 1 holds an electrophoretic bath 2. Immersed in bath 2 are sample 3 having front and back faces 6A and 6B, respectively. Counter electrode 4 is also immersed in bath 2. A positive voltage is applied to electrode 4 and a negative or ground voltage is applied to sample 3. A sound generator 5 is disposed in bath 2 in relation to sample 3 such that the vibrations produced are preferably perpendicular to the surface of sample 3 to be coated. More particularly, when sound or ultrasound waves are used to cause vibrations in the bath 2 which generate vaporous cavitations on the surface area of the immersed part 3, preferably the propagation of the waves is approximately perpendicular to the surface area of part 3. Using conventional sound generating devices, the cavitation can be caused at several meters of distance and the waves can be concentrated, even from several sound emitters, on predetermined zones of the surface area.

The process of coating by electrophoresis the surface area of the sample 3 immersed in an electrophoretic bath consists of a number of steps. First, an electrical current is made to flow between this surface area of sample 3 used as an electrode and the back electrode 4 also immersed in bath 2. When the current is flowing, vibrational movements in the vicinity of this surface are generated using the sound generator 5, preferably an ultrasound generator. The vibrational movements are applied in such a manner as to produce vaporous cavitations in the vicinity of the surface of sample 3.

The application conditions of ultrasound are adjusted in order to produce vaporous cavitation phenomena in bath 2 in the vicinity of the surface of sample 3 to be coated, at the place where one desires to prevent defects. The diameter of these cavities may influence the efficacy of the process. Ultrasound vibrational movements in fluids can cause cavitation phenomena which, in accordance with the power employed, arise from gaseous cavitation (low power), vaporous cavitation (medium power, a few W/liter) or from "empty" cavitation (high power). Gaseous cavitation does not allow one to effectively avoid surface defects, contrary to vaporous cavitation. The vaporous cavities created in the vicinity of the surface will cause the coalescence of the hydrogen bubbles during formation, thereby preventing the formation of surface defects.

The energy required to cause vaporous cavitation is independent of the frequency up to at least 100 kHz. The minimum required values of ultrasound energy are, according to different theories known on the subject, between 0.1 and 1 W/cm2; beyond this energy threshold the operating duration decreases as the power increases, between a dozen periods to one period; however, the density does not necessarily grow as a function of the power. The size of the vaporous cavities produced in bath 2 is, however, inversely proportional to the frequency.

In the absence of vibrations which cause vaporous cavitations, craterization defects appear beyond a predetermined voltage level, called "craterization voltage," and/or a predetermined rate of polarization of this substrate; therefore, in the prior art, in order to avoid these defects one applies a relatively weak voltage between the substrate and the counter-electrode, and/or one applies this voltage in a very progressive manner, which has the disadvantage of reducing the average rate of deposition and, for example, the productivity of a painting production line.

Under industrial conditions, one generally raises very quickly the polarization voltage to a voltage value greater than the craterization voltage; between the moment of the beginning of circulation of the electrophoretic current and the moment where the polarization voltage exceeds the craterization voltage, generally less than one second elapses. This rapid rise of voltage increases even more the risk of craterization, which the invention avoids. Also, the opportunity offered by the invention of using polarization voltages which are greater than the craterization voltage without risk of crater formation, as well as that of achieving increased rates of deposition, allow one to improve the unit's productivity. Further, the invention allows one to avoid surface defects while producing deposition at increased voltages, even when applied roughly. The invention thereby allows one to avoid surface defects under conditions of increased deposition rate.

With constant polarization voltage, the rate of deposition of the coating decreases as a function of the time until it is nearly canceled when the thickness of the deposited layer offers considerable electrical resistance to passage of the electrophoretic current. One can thereby achieve a given limiting thickness.

In the presence of ultrasound waves, the limiting thickness can increase by 15 to 40%. The resulting effect is identical whether one applies the ultrasound during the entire duration of polarization, or only at the end of the polarization period, during only the second half of the duration of electrophoretic passage, for example.

The vibrational movements may be applied only in an initial phase in the beginning of current flow and/or only in a second phase at the end current flow. The initial phase is in a period which begins at the beginning of the current flow and ends before the moment corresponding to half of the duration of current flow. The second phase is in a period which begins after the moment corresponding to half the duration of current flow and ends when the current flow ceases.

The application of the vibrational movements in the initial phase does not have to begin at the same time as the start of the current flow for, as an example, reasons for convenience. The initial phase may begin approximately at the moment of beginning of current flow. Similarly, the application of the vibrational movements in the second phase may extend slightly beyond the end of current flow for, as an example, reasons of convenience. The second phase may terminate approximately at the moment the current flow ceases.

Figure 2:
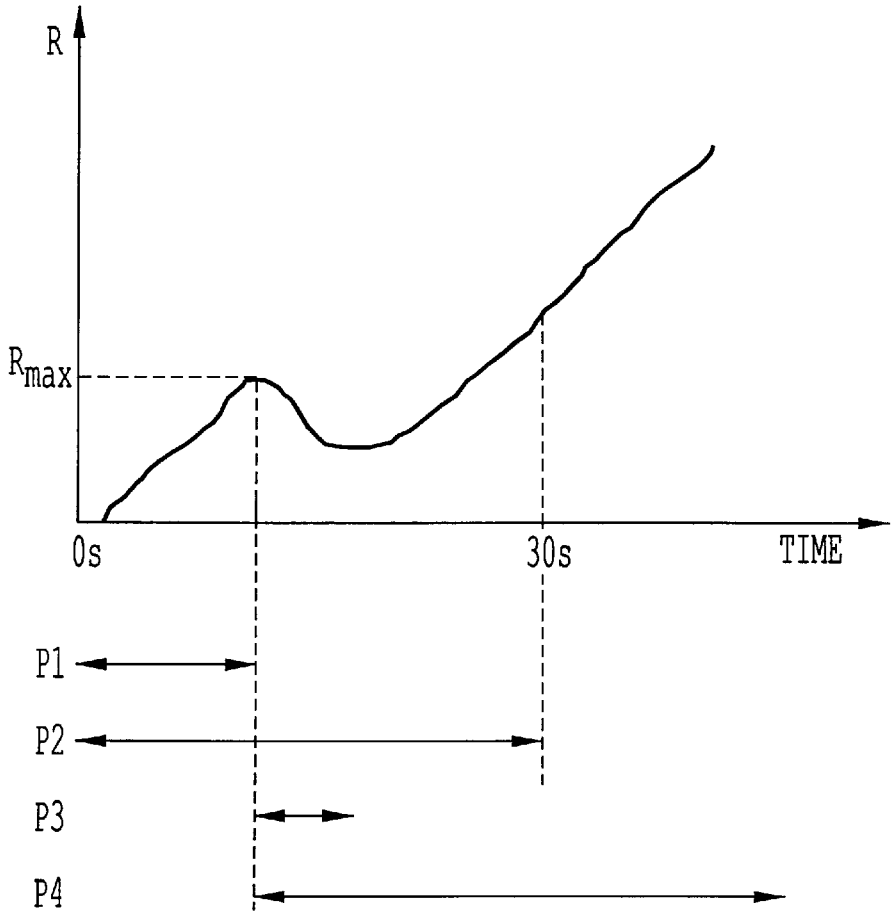
FIGS. 2 and 3 illustrate the variation as a function of time of electrical resistance R(t) between the counter-electrode and the surface area during coating, from the moment of beginning of electrophoretic current circulation.

The duration of the initial phase is preferably less than half of the duration of the current flow. More preferably, in order to achieve optimum savings for the initial phase, the initial phase is ended approximately at the moment corresponding to an inflection point of the curve R(t) of evolution, as a function of time, of the electrical resistance measured between the surface of sample 3 and the counter-electrode 4 under the same conditions but in the absence of the vibrational movements. An example of the curve R(t) is shown in FIG. 2. The inflection point is indicated as Rmax and defines the optimal length of the initial phase as P1.

By measuring the resistance R(t) of polarization at the beginning of polarization of the substrate in the absence of vibrations which generate vaporous cavitations, one will find that the resistance values regularly increase with the deposited thickness. The present inventors have determined that the growth curve as a function of time R(t) has an inflection point which reflects the appearance of the craterization phenomenon. The inventors have also verified that it is sufficient, in order to completely avoid defects, to apply the ultrasound waves only between the moment of the beginning of circulation of the electrophoretic current and the moment corresponding to this inflection point. In typical industrial practice, the duration which separates these two moments is generally less than 15 seconds, which is reflected in FIG. 2.

During the second phase the vibrational movements may be applied only in the vicinity of predetermined areas of the surface area in order to deposit a coating there that is thicker than on the other areas of the the surface area. This may achieved, for example, by adjusting the position of the ultrasound emitters 5 in the container 1 with respect to the part surface area zones onto which one desires to apply an extra thickness. One can obtain, in a single operation, a coating that has these extra thicknesses that are appropriately localized. These areas are those which may require greater protection against corrosion, such as weld joints or cross-shaped parts of articles.

In practice, it could be sufficient that the duration of the initial phase is less than or equal to one quarter of the duration of current flow, reducing to one-fourth the costs relative to the situation where the vibrations are generated during the entirety of the initial phase.

According to one variant of the invention it is possible to add, in the electrophoretic bath, cavitation adjuvants, such as a wetting agents. The agents allow the power required for causing cavitation to be reduced.

Since the duration of application of the vibrational movements during the two phases is less than the duration of the current flow, the process in accordance with the invention is less expensive than processes of the prior art which call for applying the vibrational movements during the entire duration of current flow.

In a modification of the first embodiment, the unit 1 does not include sound generators 5 in bath 2 but includes a means for causing the part to be coated 3 to vibrate at a sound or an ultrasound frequency. Thus, by causing the part to be coated 3 to vibrate instead of the bath, one can achieve the same advantages noted above.

Figure 4:
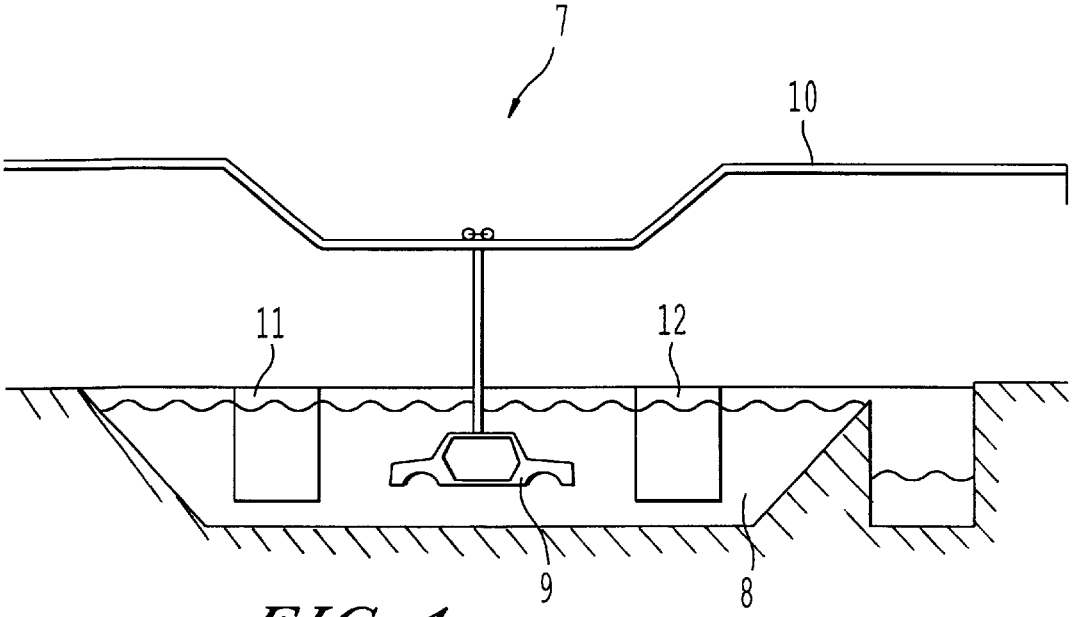
FIGS. 4 and 5 are diagrams of the coating unit according to the invention, in a side view and top view, respectively.
Figure 5:
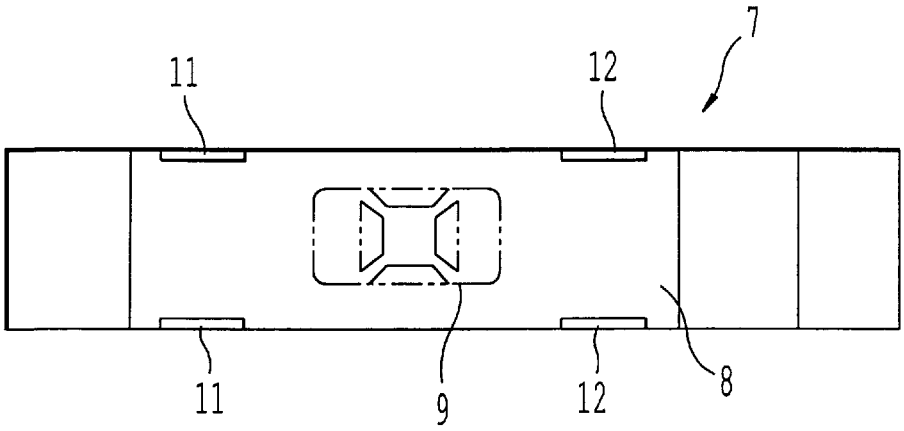

FIGS. 4 and 5 illustrate a second embodiment of the system according to the invention. A unit 7 used for coating the surfaces of parts 9 continuously by electrophoresis includes a container 8 which holds an electrophoretic bath, devices 10 for immersing the surface area, to convey the parts 9 in gradual movement in the container then of removing them from it, at least one counter-electrode immersed in the bath (not shown), means for causing an electrical current to pass between the surface area and the counter-electrode, such as a power source (not shown), and ultrasound generators 11, 12 adjusted to subject the bath in the vicinity of the surface area during movement to vibrational movements. The invention allows one to limit the zone of the bath to be subjected to vibrations to an "immersion zone" of the parts and/or only to an "extraction zone" of the parts, while limiting the craterization and/or while appreciably increasing the rate of deposition. By limiting the zone of the bath to be subjected to vibrations, the unit is considerably more economical, since ultrasound generators 11 are positioned only in the immersion zone and/or ultrasound generators 12 are positioned only in the extraction zone.

The immersion zone of the parts along the movement path begins approximately in the place corresponding to the beginning of current flow and ending at the halfway point of the length of the container. The extraction zone of the parts along the movement pathway begins at the halfway point of the length of the container and ends approximately at the place corresponding to the end of current flow. In order to achieve the optimal savings of these devices, the immersion zone ends approximately in the place corresponding to the moment corresponding to the inflection point of the curve R(t) of evolution (see FIG. 2), as a function of time, of the electrical resistance measured between this surface area and the counter-electrode under the same conditions but in the absence of the vibrational movements.

In practice, it could be sufficient for the length of the immersion zone in the direction of movement to be less than or equal to one-fourth the length of the container, reducing to one-fourth costs relative to the situation where the vibrations are generated during the entirety of the immersion zone. Thus, according to the invention, on a paint line in which the parts are conveyed at the rate of 4 m/min, in order to avoid surface defects, the parts may be subjected to ultrasound at the beginning zone of immersion over a length of approximately 1 m of the movement pathway. The duration of the initial phase is then less than or equal to one-fourth the duration of current flow and the length of the immersion zone is then less than or equal to one-fourth of the length of the immersion container.

According to one variant of this embodiment, the unit 7 does not include sound generators in the bath but means for causing the part to be coated to vibrate at an ultrasound frequency in the conveying mechanism. Thus, by causing the part to be coated to vibrate instead of the bath, the same advantages noted previously may be achieved.

Since the total length of the zones (immersion+extraction) along which one applies the vibrational movements is then less than that along which one causes an electrical current to pass, the means for applying the vibrational movements are less expensive. It is no longer necessary to install ultrasound generators in the bath all along the movement pathway of the parts to be painted, and the number and/or the useful power of the generators may be appreciably reduced, which is very economical.

The invention allows saving of installation costs while appreciably increasing the coating speed and/or avoiding defects of pitting, especially on alloy galvanized steel. The process and the device in accordance with the invention can also advantageously be used to paint automobile bodies, or parts of an automobile body such as hoods, fenders, doors or undercarriage parts.

EXAMPLE 1

This example illustrates the absence of surface defects following a deposition made with a voltage greater than the craterization voltage and below the ultrasound voltage. This example also illustrates the incidence of the direction of vibration of the bath in the vicinity of the surface area to be painted.

Tests were conducted of the coating by cataphoresis in accordance with the invention on steel samples. A substrate was selected made of alloy galvanized steel which is to be subjected to conditions in which the risk of craterization is increased. Samples were cut from a flat sheet in the format of 90×140 mm and folded in a square at the middle of the large side. As the cataphoretic bath, we used a well-known bath (reference number 718 960 manufactured by PPG Company) at a temperature of 28° C. A used bath was selected and placed under conditions in which the risk of craterization is increased.

In the vat which contains the bath was placed a plane counter-electrode, or anode, and opposite the anode, the sample to be painted. The sample to be painted then has one part parallel to the anode at a distance of 130 mm and one part perpendicular facing the anode. Several sound generators were arranged in the bath between the sample and the anode, at a distance of approximately 2 cm from the part of the sample parallel to the anode, in order to generate vibrations in a direction parallel to that part of the sample and therefore perpendicular to the other square part of the same sample. The vibrations produced in the bath had a frequency of 21,700 Hz and a power of approximately 300 W. These conditions allow vaporous cavitations to be produced in the bath, particularly in the vicinity of the surface area to be coated.

A potential difference of 220 V was maintained between the sheet to be painted and the anode until the total electrical charge transferred reaches 18 coulombs. This polarization voltage is greater than the craterization voltage, that is, the voltage at which phenomena of craterization appear in the absence of ultrasound waves. Under these conditions, the duration necessary for passage of the electrical charge of 18 coulombs is approximately 17 seconds. The resulting deposit then has a thickness between 15 and 20 micrometers.

After the coating operation the sample was removed from the bath and was dried for 20 minutes at 180° C. in order to bake the paint layer. Next, the number of defects of the "crater" type on the two painted parts of the sample, the part parallel to the anode and the perpendicular part was observed. The number of defects on the parallel part was 110, and the number of defects on the perpendicular part was 110. The direction of vibration of the bath in the vicinity of the surface area to be painted does not therefore seem determining vis-à-vis the danger of craterization.

Comparative Example 1

This example illustrates the results obtained under the same conditions as in Example 1, but in the absence of ultrasound waves. One proceeds as in Example 1, but without the sound generators. For the same electrical charge of 18 coulombs, and approximately the same thickness of coating, it is appropriate to maintain the polarization for 24 seconds. One obtains the following results: the number of defects on the parallel part was 240, and the number of defects on the perpendicular part was 225. In comparison to Example 1, the use of ultrasound allows the dangers of the "crater" type defect to be cut in half, and to improve the rate of deposition by approximately 30%.

EXAMPLE 2

This example has the goal of illustrating the incidence of the electrophoretic bath. One proceeds under the same conditions as in Example 1, but on flat samples of 100×200 mm size in a bath that has not been used before. The quantity of craters on the painted surface and the time needed for obtaining a coating thickness of a predetermined size were measured. The following results were obtained: the number of crater defects was 0, and the time of deposition was 14 seconds.

Comparative Example 2

This example illustrates the results obtained under the same conditions as in Example 2, but in the absence of ultrasound. One proceeds as in Example 2 but without sound generators and therefore without subjecting the bath to ultrasound. For a coating of the same predetermined thickness the following results were obtained: the number of crater defects was 42 and the time of deposition was 20 seconds. By comparison to Example 2 the use of ultrasound eliminates the appearance of craters and increases the deposition rate by approximately 30% over the deposition rate of Example 2.

Two types of sound generators may be installed according to the desired frequency: 68.3 kHz or 38.9 kHz. The distance between the sound generator 5 and the sample 3 may be varied and the fill level of the bath is 110 mm in height.

In order to bring about vaporous cavitation, container 1 is filled with water and a sheet of aluminum held by two gratings is used. With ultrasound waves and at sufficient power, some "impacts" will be formed on the sheet of aluminum. The quantity of impacts which result provides information on the density of cavitation.

Several series of 30-second tests at 300 W were carried out. In terms of impact density, the results obtained are reported in table 1. Here, xxxx is used to designate very great impact density, xxx for great density, xx for average density, and x for low impact density.

TABLE I influence of the sound generator-sample distance

| | Distance (cm) | | | | | | | | | |
|---|---|---|---|---|---|---|---|---|---|---|
| Sound generator-sample | 1 | 2 | 3 | 4 | 5 | 6 | 7 | 8 | 9 | 10 |
| Sound generator 16.3 kHz | xxxx | xxxx | xxx | xx | xx | xx | x | x | x | x |
| Sound generator 38.9 kHz | xx | x | x | n.o. | n.o. | n.o. | n.o. | n.o. | n.o. | n.o. |

(n.o.: not observed)

EXAMPLE 3

This example was devised to show that to more effectively limit the appearance of craterization defects by means of ultrasound devices, the application conditions of the ultrasound waves are adjusted in order to produce a vaporous cavitation phenomena in the bath in the vicinity of the surface to be coated.

An acoustic wave which propagates in a liquid medium is characterized by a succession of positive and negative pressure. The variation of pressure at one point of the liquid is called "acoustic pressure." The acoustic pressure is related to the ultrasound power dissipated in the liquid. An elevated acoustic pressure can cause local rupture of the liquid and creation of a cavity in a low pressure zone. This is the phenomenon of acoustic cavitation. At least two types of cavitation may be distinguished. The first is gaseous cavitation in which the cavity is filled with a gas initially dissolved in the liquid, or coming from materials that are immersed (walls, electrodes, etc), and the second is vaporous cavitation in which the cavity is filled with vapor of the liquid, the low pressure (or depression) in the cavity being less than the saturation vapor pressure of this liquid. Vaporous cavitation requires greater energy than gaseous cavitation. When cavities are caused in the bath in the vicinity of the surface area, two main phenomena are important for avoiding craterization defects: shock waves and micro jets, which are produced only with the vaporous cavities.

In order to bring about vaporous cavitation in a cataphoretic bath, a unit as shown in FIG. 1 is used. Container 1 which holds a bath 2. A sample 3 and a counter-electrode 4 are held immersed in the bath 2. A sound generator 5 is installed in the bath in such a way that the ultrasound vibrations that it produces are perpendicular, or approximately perpendicular, to the surface of the sample 3 to be coated.

The power value of the sound generator (300 W) pertains to the sound generator itself and not the ultrasound power dissipated in the bath in proximity of the surface area of the sample. It was determined that the low frequency of 16.3 kHz is favorable to vaporous cavitation than the high frequency of 38.9 kHz.

Next, painting tests were carried out in order to check the application conditions of the ultrasound (vaporous cavitation) and the anti-cratering effect. For a "standard" test of painting implementation, a non-phosphate coated degreased samples of alloy galvanized steel sheet were used, and an unused cataphoretic bath (made by PPG Company, reference number 718 960) maintained under mechanical stirring and at a constant temperature of approximately 28° C. The sample was gradually polarized until reaching, in approximately 10 seconds, a voltage of 220 V which we then maintained constant throughout the duration of the test. By means of the sound generator, the bath was subjected to ultrasound waves during the entire duration of the electrophoretic current circulation; the test duration was 30 seconds.

Following the test we observed the presence ("yes") or the absence ("no") of a crater on each side 6A, 6B of the sample; the results are summarized in table II.

TABLE II

Influence of ultrasound waves on crater formation

| Sample No. | Frequency (kHz) | Ultrasound power (W) | Sound generator-sample distance (cm) | Craters Side 6A | Craters Side 6B |
|---|---|---|---|---|---|
| 1 | Without | 0 | 4 | YES | YES |
| 12 | 16.7 | 50 | 2 | NO | NO |

TABLE II-continued

Influence of ultrasound waves on crater formation

| Sample No. | Frequency (kHz) | Ultrasound power (W) | Sound generator-sample distance (cm) | Craters Side 6A | Craters Side 6B |
|---|---|---|---|---|---|
| 22 | 16.7 | 50 | 3 | NO | YES |
| 3 | 16.7 | 50 | 4 | YES | YES |
| 8 | 16.7 | 300 | 2 | NO | NO |
| 2 | 16.7 | 300 | 4 | NO | NO |
| 17 | 16.7 | 300 | 5 | NO | NO |
| 18 | 16.7 | 300 | 6 | NO | NO |
| 10 | 16.7 | 300 | 7 | YES | YES |
| 4 | 16.7 | 500 | 4 | NO | NO |
| 19 | 16.7 | 500 | 7 | YES | YES |
| 13 | 38.9 | 300 | 1 | YES | YES |
| 9 | 38.9 | 300 | 2 | YES | YES |
| 15 | 38.9 | 300 | 4 | YES | YES |
| 7 | 38.9 | 500 | 4 | YES | YES |

Based on these results, at 16.7 kHz and 300 W, it is appropriate, in order to avoid craterization, that the sound generator-sample distance be less than or equal to 6 cm; this condition seems to correspond well to that of vaporous cavitation established in the preceding test series (table I).

At 16.7 kHz and 50 W, in order to avoid craterization, the sound generator-sample distance is preferably less than or equal to 3 cm. At 38.9 kHz and 500 W (heavy power), craterization was not avoided. It is possible that the diameter of the cavities is, at this frequency, too weak to be effective against craterization. The diameter of the cavities is indeed inversely proportional to the frequency on the order to 30 to 100 micrometers at 10 kHz, on the order of 15 to 50 micrometers at 20 kHz.

It was determined that the anti-crater forming effect increases when the power of the sound generator increases, or the sample-sound generator distance decreases, and the frequency of the ultrasound waves decreases.

EXAMPLE 4

This example has the goal of illustrating the use of the method for monitoring the electrical resistance of the sample during the coating process in order to discover the instantaneous level of crater formation of the surface. The same unit for painting as in Example 3 is used, with reference to FIG. 1. The sound generator 5 is installed in the bath in such a manner that the ultrasound vibrations that it produces are perpendicular to the surface of the sample 3 to be coated. The sound generator 5 was adjusted to operate at the frequency of 8 kHz, and to supply the minimum constant ultrasound power of 50 W. The distance between the sound generator and the sample is set at 11 cm.

For a "standard" painting test, samples of non-phosphate coated degreased steel sheet were used and a previously unused cataphoretic bath (made by PPG company, reference No. 718 960) maintained with mechanical stirring and at a constant temperature of approximately 28° C. was used. Sample 3 one is gradually polarized until, in approximately 10 seconds, a voltage of 220 V is reached that is kept constant during the duration of the test, The test duration is at least 30 seconds. According to one variant the "voltage rise slope" is almost 0 seconds, instead of 10 seconds. During the tests the electrical resistance between the sample 3 and the counter-electrode 4 is measured.

Under "standard" conditions and for alloy galvanized steel samples, in the absence of ultrasound waves during circulation of the current, an evolution R(t) of the resistance values as a function of the time in conformity with the diagrammatic representation of FIG. 2 is observed. The curve of R(t) has an inflection point, here a peak that corresponds to the resistance value Rmax. The shape and the amplitude of this peak (or inflection point) will depend on the applied polarization voltage. In contrast, under the same conditions but in the presence of ultrasound waves, we determine that this peak decreases or disappears completely.

In parallel fashion, after drying of the coated samples, it was determined that the samples which were coated in the absence of ultrasound waves have crater defects (on both sides 6A and 6B) while the samples coated in the presence of ultrasound waves do not have these defects. The suppression of crater formation at 8 kHz which was observed at a greater distance than in Example 3 at 17 kHz confirms that the frequency of the ultrasound waves has an effect on the suppression of crater formation. The diameter of the cavities may be one of the causal factors.

Finally, the same surface state may be obtained without defects if the ultrasound waves are applied during the entire duration of the current flow (case P2—FIG. 2) as in the prior art or if we apply them only between the moment of the beginning of passage of the current (time: 0 s) and the moment corresponding to the peak (case P1) according to the invention. Conversely, if the ultrasound waves are applied only after the peak (case P3), even during a long duration (case P4), no anti-crater forming effect of the ultrasound waves is observed.

The measurement of resistance allows one to detect the appearance of the crater-forming phenomenon during the operation of coating and that the application of the ultrasound waves only during an initial phase (case P1—FIG. 2) of the beginning of the current flow is sufficient for preventing these defects. It is likely that the ultrasound waves lower the quantity of hydrogen present on the surfaces 6A and 6B, which results in a decrease of the electrical resistance during this initial phase.

EXAMPLE 5

This example was designed to illustrate the impact of ultrasound waves on the deposition rate of the coating. The coating operations of samples were carried out for 2 minutes under the same conditions as in Example 4, and the weight of the deposited paint was measured. The application of ultrasound waves during the current flow allows appreciably increases the thickness or the deposited weight.

Figure 3:
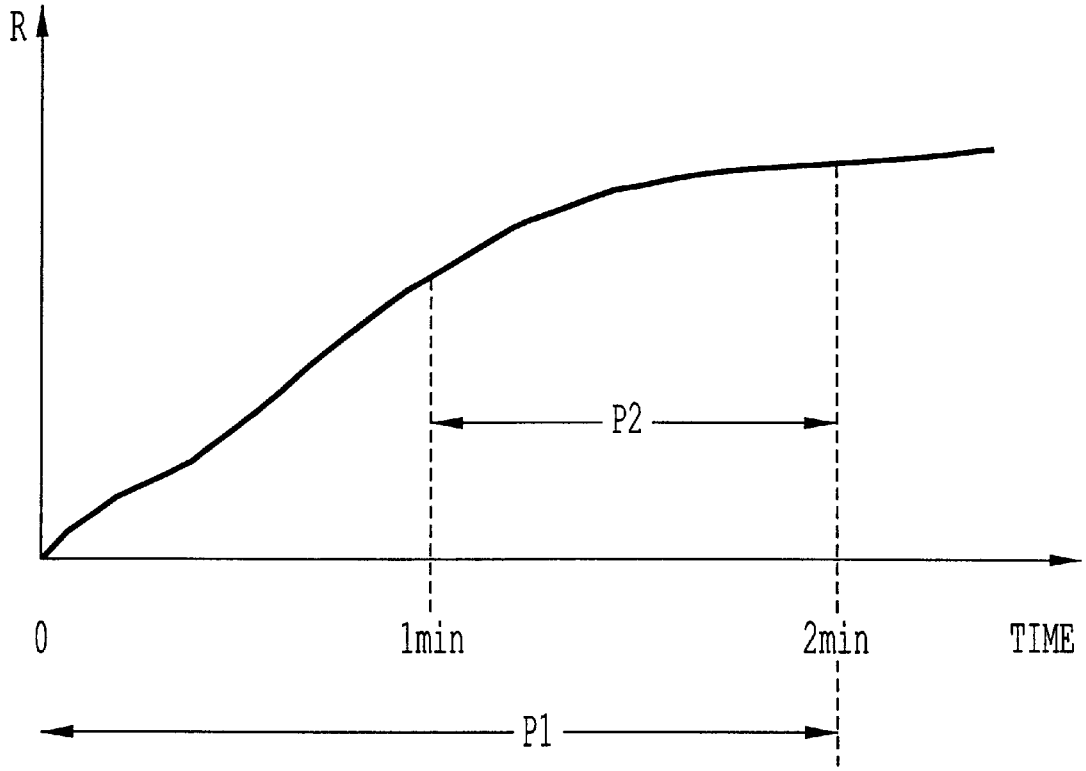

With reference to FIG. 3 the same improvement of the deposition rate was obtained whether ultrasound waves were applied during the entire duration of passage of the current (case P1—FIG. 3) or only, according to the invention, at the end of the coating operation (case P2). The application of ultrasound waves allows the rate of electrophoretic coating to be increased on all substrates. The level of improvement that results will nevertheless depend on the nature of the substrate. An increase between 30 and 35% was achieved on galvanized steel, and an increase of approximately 40% was achieved on alloy galvanized steel. Generally the mass gain that results is between 15 and 40%.

The application of the ultrasound waves only during a second phase (case P2—FIG. 3) of the end of passage of the current is sufficient to appreciably increase the average speed of deposition. Finally, the improvement of the deposition rate increases when the frequency of the ultrasound waves decreases.

EXAMPLE 6

This example was designed to illustrate, as a complement to Example 5, the influence of the treatment period with ultrasound waves on the deposition rate of the coating. The deposited weight gain (%) was measured which was brought about by ultrasound wave treatment with respect to the deposited weight on the same substrate under the same conditions but without the ultrasound waves, whether the treatment with ultrasound waves is conducted during the 10 first seconds of current flow ("0 to 10 seconds"), during the first minute of current flow ("0 to 60 seconds"), during the entire duration of current flow ("0 to 120 seconds"), or during the last minute of current flow ("60 seconds to 120 seconds"). The tests were conducted on two types of substrates, galvanized steel (GZ) and alloy galvanized steel (GA). The results are summarized in Table III as a function of the applied polarization voltage.

TABLE III gain (%) of weight deposited under ultrasound waves

| | | Period of subjection to ultrasound waves | | | |
|---|---|---|---|---|---|
| Substrate | Voltage | 0 to 10 s | 0 to 60 s | 0 to 120 s | 60 to 120 s |
| GZ | 190 V | 11% | 33% | 40% | 47% |
| GA | 190 V | 8% | 22% | 28% | — |
| GA | 220 V | 0% | 18% | 20% | 35% |

The increase of the deposition rate remains very low when one applies the ultrasound waves in the beginning phase of the current flow and that it reaches a maximum when one applies them during the end of current flow phase.

EXAMPLE 7

This example was designed for comparing the effect of the ultrasound waves on a bare metal surface area and on a phosphate-coated metal surface area. Before painting of the metal surface areas, it is common to carry out a phosphate coating treatment; it is therefore important to verify that this treatment does not harm the effectiveness of the ultrasound waves. It was determined, by observation under a scanning electron microscope, that the application of the ultrasound waves does not seem to disturb the appearance of the phosphate layer. It was also determined that the application of ultrasound waves offered the same advantages (anti-crater forming effect—improvement of the deposition rate) for the phosphate-coated surface as it did for the bare surface.

In the case of phosphate layers, the application of ultrasound waves during periods of time that are shorter than in the prior art, which means only in an initial phase of the beginning of the current flow and/or only in a second phase at the end of the current flow, limits the dangers of degradation of the phosphate layer.

Obviously, numerous modifications and variations of the present invention are possible in light of the above teachings. It is therefore to be understood that within the scope of the appended claims, the invention may be practiced otherwise than as specifically described herein.

What is claimed and desired to be protected by letters patent is:

1. A coating process by electrophoresis of a surface of a substrate immersed in an electrophoresis bath, comprising:

applying an electrical current to said surface;

during applying said current, subjecting one of the bath and the sample to vibrational movements to generate vaporous cavitations in said vicinity of said surface; and applying said vibrational movements for a period substantially less than a time period over which said current is applied.

2. A process as recited in claim 1, comprising:

generating said vibrational movements only during at least one of an initial phase at a beginning of application of said current and a second phase at an end of application of said current, wherein:

said initial phase begins approximately at the onset of said application of said current and ends before a time corresponding to half of a duration of application of said current, and said second phase begins after said time and ends approximately at an end of said application of said current.

3. A process as recited in claim 2, comprising:

ending said initial phase approximately at a moment corresponding to an inflection point of a characteristic, as a function of time, of electrical resistance measured between said surface and a counter-electrode under the same conditions but in the absence of the said vibrational movements.

4. A process as recited in claim 2, comprising:

generating said vibrational movements in said initial phase for no more than one fourth of a duration of the application of said current.

5. A process as recited in claim 2, comprising:

generating said vibrational movements only in said initial phase.

6. A process as recited in claim 2, comprising:

during said initial phase, applying a current to produce a polarization voltage greater than a crater forming voltage of the said surface.

7. A process as recited in claim 6, comprising:

applying current such that a duration of a rise of said polarization voltage rise up to a predetermined value greater than said crater forming voltage is less than 1 second.

8. A process as recited in claim 2, comprising:

generating said vibrational movements only in the vicinity of predetermined zones of said surface.

9. A process as recited in claim 2, comprising:

generating said vibrational movements only in said second phase.

10. A process as recited in claim 1, comprising:

determining an inflection point in a characteristic of electrical resistance between said surface and a counter electrode as a function of time determined in absence of said vibrational movements; and stopping the generation of said vibrational movements at a time approximately corresponding to said inflection point.

11. A process as recited in claim 1, comprising:

generating said vibrational movements in said bath using one of sound and ultrasound waves.

12. A process as recited in claim 1, comprising:

generating said vibrational movements by vibrating said substrate at one of sound and ultrasound frequencies.

13. A process as recited in claim 1, comprising:

coating a substrate made of alloy galvanized steel.

14. A process as recited in claim 1, comprising:

immersing said substrate in said bath;

conveying said substrate through said bath; and extracting said substrate from said bath.

15. A process as recited in claim 14, comprising:

generating said vibrational movements only during at least one of an initial phase including said immersing step at a beginning of application of said current and a second phase including said extracting step at an end of application of said current.

16. A process as recited in claim 15, comprising:

ending said initial phase approximately at a moment corresponding to an inflection point of a characteristic, as a function of time, of electrical resistance measured between said surface and a counter-electrode under the same conditions but in the absence of the said vibrational movements.

17. A process as recited in claim 15, comprising:

generating said vibrational movements in said initial phase for no more than one fourth of a duration of said immersing, conveying and extracting steps.

18. A process as recited in claim 15, comprising:

generating said vibrational movements only in said initial phase.

19. A process as recited in claim 15, comprising:

generating said vibrational movements only in the vicinity of predetermined zones of said surface during said second phase.

20. A process as recited in claim 15, comprising:

generating said vibrational movements only in said second phase.

21. A process for coating a surface of a substrate, comprising:

immersing said surface in an electrophoresis bath;

extracting said surface from said bath; and applying vibrational movements to one of said surface and said bath to generate vaporous cavitations in the vicinity of said surface at only at least one of an immersion point and an extraction point.

22. A process as recited in claim 21, comprising:

applying said vibrational movements at only said immersion point.

23. A process as recited in claim 21, comprising:

applying said vibrational movements at only said extraction point.

24. A process as recited in claim 23, comprising:

applying said vibrational movements to only predetermined portions of said surface.

25. A process as recited in claim 21, comprising:

applying a current to said surface using a counter-electrode; and applying said vibrational movements during application of said current up to approximately a moment corresponding to an inflection point of a characteristic, as a function of time, of electrical resistance measured between said surface and a counter-electrode in the absence of said vibrational movements.

26. A process as recited in claim 1, comprising:

generating said vibrational movements only in the vicinity of predetermined zones of said surface.

27. A process as recited in claim 1, comprising:

applying said vibrational movement after said applying said electrical current to said surface, and continuing thereafter for said period.

28. A process as recited in claim 2, wherein said initial phase begins approximately at the onset of said application of said current, continues for a predetermined time and ends before said time corresponding to half of said duration of application of said current.

* * * * *